United States Patent [19]

Nakasuji et al.

[11] Patent Number: 5,011,445

[45] Date of Patent: Apr. 30, 1991

[54] COLOR MEMORY TOY SET

[75] Inventors: Norikazu Nakasuji, Aichi; Tsutomu Kito, Gifu; Yutaka Shibahashi, Aichi, all of Japan

[73] Assignee: The Pilot Ink Co., Ltd., Aichi, Japan

[21] Appl. No.: 476,941

[22] Filed: Feb. 8, 1990

[30] Foreign Application Priority Data

Feb. 9, 1989 [JP] Japan ..... 1-14436[U]

[51] Int. Cl.[5] ..... A63H 33/22

[52] U.S. Cl. ..... 446/14; 446/385; 401/1; 434/328

[58] Field of Search ..... 446/14, 385, 491; 401/1, 2; 434/328; 427/148, 150

[56] References Cited

U.S. PATENT DOCUMENTS

| | | | |
|---|---|---|---|
| 1,592,148 | 7/1926 | Munn . | |
| 4,028,118 | 6/1977 | Nakasuji et al. | 106/21 |
| 4,176,273 | 11/1979 | Fujie et al. | 401/1 X |
| 4,720,301 | 1/1988 | Kito et al. | 106/21 |
| 4,725,462 | 2/1988 | Kimura | 446/14 X |
| 4,818,215 | 4/1989 | Taga | 431/126 |
| 4,820,683 | 4/1989 | Vervacke et al. | 503/210 |
| 4,895,827 | 1/1990 | Vervacke et al. | 503/210 |
| 4,917,643 | 4/1990 | Hippely et al. | 446/14 |
| 4,920,991 | 5/1990 | Shibahashi et al. | 132/73 |

FOREIGN PATENT DOCUMENTS

| | | | |
|---|---|---|---|
| 2205255 | 12/1988 | United Kingdom | 446/14 |

*Primary Examiner*—Mickey Yu

*Attorney, Agent, or Firm*—Fitzpatrick, Cella, Harper & Scinto

[57] ABSTRACT

A color memory toy set has a color memory toy with surface, at least one portion of the surface being provided with a color memory temperature-sensitive color changing layer colored with a coloring material including a color memory temperature-sensitive dye exhibiting hysteresis characteristics in response to temperature change between a colored state and a colorless state or between a color (I) state and a color (II) state. The toy set also includes a writing pen for either causing an image to appear or disappear on the color memory temperature-sensitive layer by drawing the image on the layer to change the color state of the drawn portion into a first state, or for causing an image to appear or disappear on the color memory temperature-sensitive layer by drawing the image on the layer to change the color state of the drawn portion to a second state.

6 Claims, 1 Drawing Sheet

COLOR MEMORY TOY SET

BACKGROUND OF THE INVENTION

The present invention relates to a toy set and in particular, to a toy set having a toy with color memory, and hot and cold-pens, wherein the hot and cold-pens are used to draw an arbitrary image on or mark a temperature-sensitive color changing layer of the toy to cause the image or mark to appear or disappear.

Conventional temperature-sensitive color changing materials include a reversible temperature-sensitive color changing dye. Such materials are used extensively in a wide variety of fields and have a temperature at which the material changes color. The material assumes one of two color states within a room temperature range. That is, the material assumes the other of the two color states only during the period that it is supplied with the heating (or chilling) which is required to cause such state to appear. The material then returns to the one state within the room temperature range as soon as the heating or chilling is terminated and that temperature range is reattained.

A quasi-reversible temperature-sensitive color changing material has been developed which uses the quasi-reversible temperature-sensitive dye disclosed in U.S. Pat. No. 4,720,301 issued Jan. 19, 1988 upon U.S. patent application Ser. No. 807,908, filed Dec. 11, 1985 and assigned to the Pilot Ink Co., Ltd. In response to temperature change, this material exhibits a hysteresis characteristic in which the surface color of the material changes between either colorless and colored states, or between a color (I) and a color (II) in response to a change in temperature, where any of the color or colorless states can be selectively maintained at room temperatures.

SUMMARY OF THE INVENTION

An object of the present invention is to provide a color memory toy set comprising a heating or a chilling device which permits a user to either change the color of a part of a color memory toy, or to return the color of that part to its previous color. That is, it is an object of the present invention to permit a user to make an arbitrary image or mark, or to easily erase an image or mark, and thereby effectively bring out the characteristics of the color memory toy to enhance both its properties and variety.

DETAILED DESCRIPTION OF THE INVENTION

Figure 1:
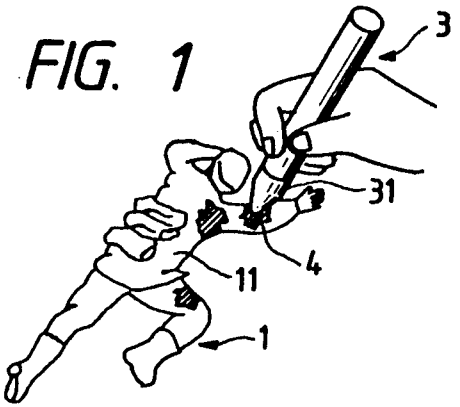
FIG. 1 is a perspective view showing a color memory doll upon which wounds have been drawn with a hot-pen and in which the wound images are being traced with a cold-pen in order to disappear.

The present invention will now be described with reference to the drawings in which a color memory toy set according to the present invention includes a color memory toy 1, a hot-pen 2 and a cold-pen 3. At least one portion of the surface of the color memory toy 1 is provided with a color memory temperature-sensitive color changing layer 11. Color changing layer 11 is formal of a coloring material consisting of (a) an electron-supplying coloring organic compound, (b) an electron-accepting compound, and (c) an ester compound causing hysteresis characteristics. The color of the color memory dye is charged with large hysteresis characteristics in response to temperature change. A reversible thermochromatic color change composition disclosed in U.S. Pat. No. 4,720,301 is preferably used as the color memory temperature-sensitive dye. Specifically, the color memory temperature-sensitive dye exhibits a hysteresis characteristic in response to temperature change between a colored and colorless states, or between a color (I) and a color (II). The hot and cold-pens 2 and 3 are used on color memory temperature-sensitive color changing layer 11 to draw an image on or make a mark by changing the color of the drawn or marked portion so that the image or mark appears or disappears.

Lower dye color-changing temperature t1(°C.) and higher dye color changing temperature t2(° C.) are arbitrary selected from the temperature range of 0°–50° C. Temperatures t1 and t2 satisfy the following equation $5 \leqq t2 - t1 \leqq 35$ wherein $t2 > t1$. Preferably, the lower color-changing temperature t1(°C.) satisfies the condition $5 \leqq t1$(° C.)$\leqq 23$ and the higher color-changing temperature t2 satisfies the condition $24 \leqq t2 \leqq 40$. One of two colors (or a coexisting state of the two colors) may be selected by either chilling the colored portion below t1 or heating it over t2. The selected color state can thereafter be stably maintained within the temperature range of t1 to t2.

Figure 6:
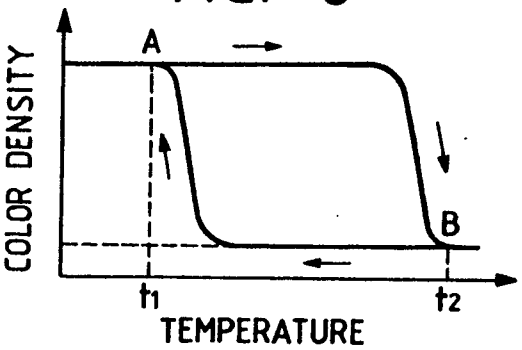
FIG. 6 illustrates the color state hysteresis characteristic of the color memory thermochromatic dye in response to the change of temperatures.

This hysteresis characteristic means that the curve obtained by plotting the change in color density of the case where the temperature increases from below the color-changing temperature differs from the case where the temperature decreases from above the color-changing temperature range. Thus, as illustrated in FIG. 6, a loop is formed when these two curves are combined. Assuming that temperature "A" (where the two curves join at the lower temperature side) is t1(°C.), i.e., the lower color-changing temperature, and temperature "B" (where the two curves join at the higher temperature side) is t2(°C.), i.e., the higher color-changing temperature. Temperature t1 of the color memory temperature-sensitive dye in the present invention is in the range of 0° to 23° C. Such a temperature may be obtained from cold spray, ice or cold water, and the like. Temperature t2 is in the range of about 20 to 90° C., which may be obtained, for example, from body temperature, bath water temperature, a hair dryer and the like. Additionally, a dual-state coexisting ("dual-color holding") temperature range where both the color and colorless states, or both color (I) and color (II) can coexist, is within a room temperature range. It is especially preferred that the dual-color holding temperature range be within 10°–35° C. (see FIG. 6).

The color memory temperature-sensitive dyes may include those having different color and those having different dual-color temperature ranges within the room temperature range such as, for example, a combination of two kinds of dyes wherein the dual-color temperature range of one of the dyes is both wider than that of the other and includes the narrower dual-color temperature range, and a combination of color memory temperature-sensitive dyes having different hysteresis characteristics. Application of these dyes on the same or different surfaces of the toy can provide a wide variety of reversible patterns and designs.

The aforementioned color memory temperature-sensitive color changing dye is dispersed in a suitable carrier liquid or vehicle so as to be used as a coloring material in the form of ink or paint, which is applied to a desired portion of the surface of the toy. Of course, the above-mentioned treatment may also be applied on the surface of members of the toy before assembly thereof Additionally, if the base material of the toy is thermoplastic, the toy may be preformed with the above coloring material.

The color memory dye is preferably utilized in the form of a microcapsule having a diameter of 0.5–50 μm, more preferably about 1–30 μm to form a microcapsule pigment. The microcapsule pigment is dispersed within a binder which is then fixed to form a painted layer The percentage cf the pigment in the layer is 5–80 weight %, more preferably 10–60 weight % in view of thermochromatic effect. That is, the percentage is less than 5 weight %, the color density is so low that color change is not noticeable while if the percentage is larger than 80 weight %, a clear colorless state is not easily obtained.

When the members of a toy are made of the thermoplastic material, the toy can be made by melting and molding the material mixed with the microcapsule pigment of 0.1–40 weight %, preferably 0.2–25 weight %, in which the color memory dye is included.

Similarly, the thickness of color memory temperature-sensitive color changing layer 11 is at least 0.5 μm, preferably 1–400 μm, more preferably 10–200 μm so as to obtain a satisfactory color change effect. If the thickness is less than 0.5 μm, clear color change is not obtained while a thickness larger than 400 μm damages the appearance of the toy.

The hot-pen 2 and the cold-pen 3 used for heating or chilling desired portions cause an image or a mark to appear or disappear. This is done by touching the pens to a color memory temperature-sensitive color changing layer 11 of the aforementioned color memory toy 1 to locally increase the surface temperature up to above about 20° C. but less than about 90° C. which is higher than the room temperature or decrease it to a temperature of about 15° C. which is lower than the room temperature to cause a change in color thereby. Pens 2 and 3 do not have to be separate but may, of course, be constructed such that one end of a bar-shaped body forms the hot pen and the other end forms a cold pen.

The tip ends of the hot-pen 2 and the cold-pen 3 may take various shapes as desired For example, the pens may provide a conical tip end, branching tip end, a flat surface, or an image of any predetermined letter or pattern. Thus, the pens can also be provided with the function of stamping, in addition to a function of drawing. Also, the tip end of the pen may also be provided with suitable patterns, such as having a plurality of small bosses on the surface thereof, a comb configuration, or a brush-like member.

The hot-pen 2 and the cold-pen 3 may be made of any writing material that meets the aforementioned temperature conditions. For example, a pen can be constructed with a supporting body which supports a pen body having a longitudinally extending ink path, or a porous pen body of a material such as plastic having continuous pores, and processed fiber material. Drawing could then be performed by guiding hot water or cold water from a storage portion in a barrel through the pen body. The pen may also be constructed to allow hot or cold water to penetrate directly to perform drawing, or to provide a hollow tip end portion of increasingly smaller diameter which is closed so as to function a writing-tip.

The hot-pen 2 may be constructed with a pen body 21 having a tip end portion made of metal supported at one end of barrel 22 and in contact with a heat medium 23 that conducts heat. Although the heat medium 23 can be filled directly in the barrel 22, if an inner pipe 24 connected to the pen body 21 is disposed within barrel 22 to receive heat medium 23, leakage may be prevented thereby precluding any danger caused when a user grips barrel 22. This also allows the pen to effectively function in terms of maintaining chilled condition. Heat medium 23 may be provided by warm or hot water, as well as solvents having a high boiling point, sand, or metal powder heated to a high temperature. The inner pipe 24 may be provided to extend behind the pen body 21 integrally therewith. The cold pen 3 may be arranged by filling ice or cold water, instead of the heat medium 23, in the barrel 22.

The barrel or the writing tip end of the hot-pen 2 or cold-pen 3 may be provided with a reversible thermochromatic layer to indicate whether the temperature of the pen is in the suitable temperature range.

Drawing or marking the color memory temperature-sensitive color changing layer 11 with the hot-pen 2 or the cold-pen 3 heats or chills the drawn or marked portion to cause color change, thereby shifting into a stage different from that at room temperatures (from a colorless state to a colored state, from color (I) to color (II), or vice versa) and thereafter retaining the new image state. Redrawing or marking the previously drawn image or mark with a counter pen (i.e., the cold-pen 3 instead of the hot pen, and the hot-pen 2 instead of the cold pen 3) will cause the portion to change its color so that of the previous state (i.e., the state before the initial drawing or marking) so as to erase the drawn image or mark. This change in state is reversible.

Specific examples of the hot-pen and the cold-pen will now be described as follows.

EXAMPLE 1

Figure 2:
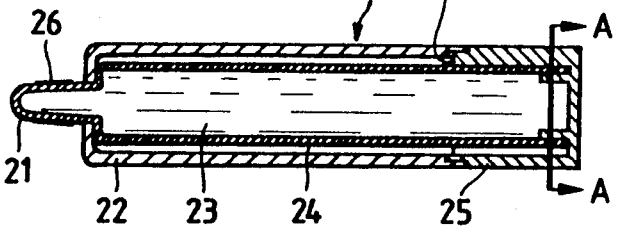
FIG. 2 is a longitudinal cross-sectional elevation of an example of a hot-pen.
Figure 3:
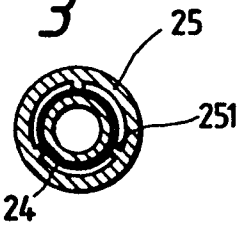
FIG. 3 is a transverse cross-sectional elevation taken along line A—A of FIG. 2.

The hot-pen 2 comprises a bullet-shaped pen body 21 having an integral inner aluminum pipe 24 (0.3 mm thick 10 cm long) of a diameter of 11 mm, the diameter of one end of which decreases stepwise to form the pen body, a barrel 22 (0.3 mm thick, 15 mm outer diameter) of polypropyrene resin around inner pipe 24 therein, and a tail cap 25. Beads 251 are provided on the inner wall of the cap to support the rear portion of inner pipe 24. The writing-tip end portion is provided with a reversible thermochromatic layer 26 that exhibits red at temperatures higher than 35° C. and deep green at temperatures less than 20°). Hot water (about 60° C.) is filled in the inner pipe 24 immediately before the pen is used. See FIGS. 2 and 3.

EXAMPLE 2

Fine sand is filled instead of hot water in the aforementioned inner pipe 24. The writing tip end portion is regulated to become a temperature of about 60° C. shortly after assembly. In assembly procedure, the inner pipe 24 (including the pen body 21) retained with the tail cap 25 is heated while filed with fine sand and tail cap 25 is then pinched in order to allow the insertion of pipe 24 into barrel 22.

EXAMPLE 3

Figure 4:
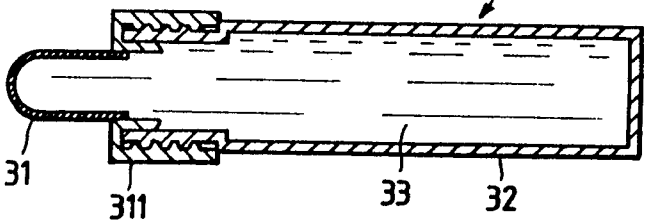
FIG. 4 is a longitudinal cross-sectional elevation of an example of a cold-pen.

A cold-pen 3 is obtained by fixing a pen body 31 made of a metal hollow body, the front end of which is closed, in a holding member 311, then fastening the member 311 to a plastic barrel 32 filled with cold water or pieces of ice. See FIG. 4.

EXAMPLE 4

Figure 5:
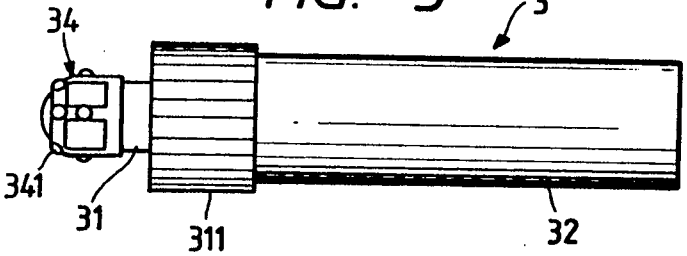
FIG. 5 is a side elevation of another example of a cold-pen.

A cold-pen 3 is obtained by attaching an attached member 34 having small bosses 341 to the tip end of the pen body 31 of Example 3. See FIG. 5.

EXAMPLE 5

A cold-pen 3 is obtained by filling cold water (about 5° C.) instead of hot water into the pen of Example 1.

EXAMPLES 6 AND 7

Hot-pens 2 are obtained by filling hot water (about 60° C.) instead of the cold water into the pens of Examples 3 and 4, respectively.

EXAMPLE 8 AND 9

The pen body 21 of Example 1 or the pen body 31 of Example 3 is replaced 22 a pen body of a plastic hollow body having a thin wall, the tip end of which is shaped into a bullet, is attached, respectively to form a hot-pen 2 or a cold-pen 3.

EXAMPLE 10

A pen body 21 or 31 is formed of a plastic hollow body having a closed tip end and in a side wall in which metal pieces are inserted is attached to the end of a barrel filled with hot water or cold water, so that a cold pen 2 or a hot-pen 3 is obtained. The metal surface of the side wall is touched to perform the function of drawing.

EMBODIMENT 1

A pigment including a color memory temperature-sensitive dye which changes color between deep green and red ($t_1$: 10° C., $t_2$: 32° C.) and another pigment including a color memory temperature-sensitive dye which changes color between brown and red ($t_1$: 10° C., $t_2$: 32° C.) were made. A color memory doll 1 of a soldier was sprayed with the former pigment on a helmet, a uniform jacket and a uniform pant, and with the latter pigment on a pair of gloves and boots. The doll was then dryed. The doll was green and brown in the room temperature range.

Patterns of wounds could then be drawn be a shoulder, arm, and leg of the soldier using the hot-pen 2 to change the color of the drawn image 4 to red, thus changing the doll to a "wounded" solder. Afterwards, tracing the "wounded" part using the cold-pen 3 caused the red to disappear and return to the previous deep green and brown. The soldier thus returned to the previous "unwounded" condition. Again drawing a pattern of wound on his back by using the hot-pen caused that part to change to red, thereby changing the soldier to a soldier who was "wounded" on his back.

EMBODIMENT 2

A pattern of a "business suit" was printed on the clothes of a doll using ink, color of which would not change (i.e., ordinary pigment ink), and then a pattern of a battle dress was printed over the previous "business suit" using a color memory temperature-sensitive dye reversible between deep green and colorless state ($t_1$: 15° C., $t_2$: 32° C.), thereby completing a color memory doll. This doll was arranged so that the pattern of the deep green battle dress is observed in a room temperature range.

Drawing on the pattern of the battle dress caused a pattern under the drawn portion to appear, and further drawing on all the battle dress pattern caused the business suit pattern to be observed Then, drawing on the business suit pattern with the cold-pen 2 caused the deep green image to be observed and further drawing on all the pattern caused the business suit to turn out to be the battle dress to return.

EMBODIMENT 3

A metal miniature car was made to have a dual appearance body by spraying a pigment containing a color memory temperature-sensitive dye reversible between red and yellow ($t_1$: 18° C., $t_2$: 32° C.) to the surface of the car. The body was retained to be red in a room temperature range. The upper half of the body was drawn upon by the hot-pen 2 to cause it to change to yellow, thus allowing the miniature car to be changed to a car of two-tone color of red and yellow. The surface of the yellow body is then drawn upon with the cold-pen 3 to cause the yellow part to change to red, thereby allowing the body to return to the previous appearance.

This change in appearance was obtained with good repeatability through repetitive operation so that the car color can be repeatedly changed.

EMBODIMENT 4

The surface of a white miniature car was printed to make a dotted line on its side surface and letters on its roof using an ink containing a color memory temperature-sensitive dye which is reversible between black and colorless ($t_1$: 15° C. $t_2$: 35° C. ). The miniature oar was then dipped into warm water of about 40° C. and removed, thus being placed in an invisible state in which the printed images disappeared in a room temperature range.

Drawing on the printed image portion by using the cold-pen 3 caused a black dotted line and the letters to appear. Tracing those images using the hot-pen 2 caused the images to disappear, allowing the car to return to its white color.

EMBODIMENT 5

The surface of a white miniature car was painted to have its yellow body observed at a room temperature (22° to 33° C.) by spray-painting a spray ink that was made by mixing a color memory temperature-sensitive dye reversible between blue and colorless ($t_1$: 13° C., $t_2$: 30° C.), a color memory temperature sensitive dye reversible between pink and colorless ($t_1$: 20° C., $t_2$: 36° C.), and a yellow pigment, the color of which does not change.

The lower half portion of the car was painted by using the cold pen 3 to cause it to change to brown (this state was retained at a room temperature of 15°-27° C.).

Then, warming the miniature car by cupping it within human hands caused the lower half portion to change to pink, which color was retained at room temperature (15° to 33° C.). Thereafter, drawing a letter (A-1) on the lower half portion using the hot-pen 3 caused the white drawn image to appear. Writing upon the upper half portion using the cold-pen then caused the written portion to change to a brown state which was retained at a room temperature (15° to 27° C.). When the miniature car was then dipped into warm water of 40° C., the white miniature car again appeared. Additionally, the entire body of the miniature car was chilled by ice water (or the cold-pen) in order to set the entire car body to brown whereby the above operation was repeated. The miniature car exhibited the same color change, thus allowing the user to repetitively play with the car.

EMBODIMENT 6

Flower pattern was printed on a piece of polyester cloth of light blue by using ink of yellow and light green that would not change in color, and then the entire cloth including the flower pattern was screen-printed by using a printing ink containing a color memory temperature-sensitive dye reversible between red and colorless ($t_1$: 15° C., $t_2$: 32° C.). A dress was made from the thus printed cloth. A doll made of polyvinyl chloride resin was dressed with this cloth, thus being a color memory toy doll. The hair portion of the doll was formed of nylon filaments with color memory temperature-sensitive color changing material reversible between brown and silver ($t_1$: 15° C., $t_2$: 35° C.) blended therein. The cloth of the doll was set such that the flower pattern in a background of the light blue was seen, and the hair portion was retained in silver in a room temperature range.

Drawing letters or patterns on the surface of the cloth of the doll by using the cold pen 3 caused the drawn portion to immediately change to red, thereby allowing observation of the image. Also, drawing the entire printed flower pattern using the cold-pen 3 caused the flower pattern to change to red so that the flower pattern was hidden and became invisible. Similarly, drawing on the hair portion by using the cold-pen 3 caused the drawn filaments to change to brown. This state was held in a room temperature range. Tracing the color-changed parts of the cloth and hair by using the hot-pen 2 caused these parts to return to their original states.

The change in state was repeatedly obtained through repetitive operation, allowing the user to play by drawing on any appropriate portion of the doll to cause the images to appear or disappear.

EMBODIMENT 7

A pigment containing a color memory temperature-sensitive dye was applied to a plastic house, chair, and table which had been painted with a white pigment having no color-changing property (general pigment ink), thereby forming a color memory toy. In more detail the roof portion was painted with a pigment reversible between deep green and red ($t_1$: 13° C., $t_2$: 32° C.). the wall portion was painted with a pigment reversible between yellow and a colorless ($t_1$: 13° C. $t_2$: 32° C.) the floor portion was painted with a pigment reversible between brown and light brown ($t_1$: 13° C., $t_1$: 32° C.), and the chair and the table were painted with a pigment reversible between brown and colorless ($t_1$: 13° C., $t_2$: 32° C.), thus providing a color memory temperature-sensitive color changing layers At a room temperature, the roof was red, the wall white, the floor light brown, and the chair and the table white. The respective parts mentioned above were drawn by the cold-pen 3 to cause letters and patterns to appear, or drawing on all the surface of the respective parts caused color change of the roof into deep green, the wall into yellow, the floor, chair, and table into brown. The aforementioned drawn image and the state of the surface could be erased and returned to the original state by tracing the same portion by the hot-pen 2.

As described above, a user can easily draw a desired image on or mark the surface of a color memory toy without constraint using a hot-pen or a cold-pen to cause the image or mark to appear and to be seen. Further, the user can easily erase the image by using the pens into the original state. Thus, the toy provides the user with various image states. Accordingly, with the addition of the characteristics of the color memory toy, the color memory toy set provides such a toy with a high additional educating value and enhances the value of the toy as a commodity. Since the present invention enables drawing and erasing of the image with pens can be conducted without using coloring components, the health of the child or other user is not endangered by harmful chemicals and there is no fear of damaging clothes or the toy itself, so that an infant, a school child or the like can safely use it.

What is claimed is:

1. A color memory toy set, comprising:

a color memory toy having a surface, at least one portion of said surface being provided with a color memory temperature-sensitive color changing layer colored with a coloring material comprising a color memory temperature-sensitive dye exhibiting hysteresis characteristics in response to temperature change between either (i) a colored state and a colorless state or (ii) a first color state and a second color state; and at least one simulated writing pen, said simulated writing pen comprising a pen body with a metal simulated writing tip end and a hollow pipe, wherein hot water as a heat medium or pieces of ice or cold water as a chilling medium can be freely inserted and removed therefrom so as to respectively form a hot-pen or a cold-pen thereby;

wherein said hot-pen causes at least a part of an image to appear or disappear on said color memory temperature-sensitive layer by drawing an image on said layer whereby to change the color state of the drawn portion into a first state and said cold-pen causes at least a part of an image to appear or disappear on said color memory temperature-sensitive layer by drawing an image on said layer whereby to change the color state of the drawn portion to a second state.

2. A color memory toy set as claimed in claim 1, wherein said color memory temperature-sensitive dye includes (i) an electron-supplying coloring organic compound, (ii) an electron-accepting compound and (iii) an ester compound causing the hysteresis characteristics, wherein a lower color-changing temperature $t_1$(°C.) and a higher color-changing temperature $t_2$(°C.) of said dye are arbitrarily selected from the temperature range of 0°–50° C., and are determined to satisfy the following equation: $5 \leqq t_2 - t_1 \leqq 35$ ($t_2 > t_1$), wherein one of the color states or a coexisting state of the two color states is arbitrarily selected by chilling said color memory temperature-sensitive color changing layer below $t_1$(°C.) or heating said layer over $t_2$(°C.), and wherein the selected state is maintained in the temperature range of $t_1$ to $t_2$ irrespective of the temperature change.

3. A color memory toy set as claimed in claim 1, wherein said hollow pipe and metal tip end are integral and said hollow pipe is contained in an external barrel contacting said hollow pipe.

4. A color memory toy set as claimed in claim 1, wherein said hollow pipe is detachable from said writing tip.

5. A color memory toy set as claimed in claim 1, wherein said writing tip end is provided with an embossed image.

6. A color memory toy set as claimed in claim 1, wherein said pen body is provided with a reversible thermochromatic color changing layer.

* * * * *

UNITED STATES PATENT AND TRADEMARK OFFICE

CERTIFICATE OF CORRECTION

PATENT NO. : 5,011,445

DATED : April 30, 1991

INVENTOR(S) : NORIKAZU NAKASUJI ET AL.

It is certified that error appears in the above-identified patent and that said Letters Patent is hereby corrected as shown below:

COLUMN 2

Line 11, "formal" should read --formed--.
Line 30, "color changing" should read --color-changing--.
Line 31, "arbitrary" should read --arbitrarily--.
Line 32, "equation" should read --equation:--.

COLUMN 3

Line 17, "thereof" should read --thereof.--.
Line 25, "layer The" should read --layer. The--.
Line 26, "cf" should read --of--.
Line 28, "is, the" should read --is, if the--.
Line 51, "temperature or" should read --temperature, or--.
Line 58, "desired For" should read --desired. For--.

COLUMN 4

Line 11, "function a" should read --function at a--.
Line 42, "hot pen," should read --hot-pen 2,--.
Line 44, "so" should read --to--.
Line 53, "thick 10 cm" should read --thick, 10 cm--.
Line 56, "polypropyrene" should read --polypropylene--.
Line 62, "20°)." should read --20°C.--.

COLUMN 5

Line 4, "filed" should read --filled--.
Line 31, "replaced 22" should read --replaced by--.
Line 58, "drawn be" should read --drawn on--.

UNITED STATES PATENT AND TRADEMARK OFFICE

CERTIFICATE OF CORRECTION

PATENT NO. : 5,011,445

DATED : April 30, 1991

INVENTOR(S) : NORIKAZU NAKASUJI ET AL.

It is certified that error appears in the above-identified patent and that said Letters Patent is hereby corrected as shown below:

COLUMN 6

Line 16, "observed Then," should read --observed. Then,--.
Line 45, "oar" should read --car--.
Line 62, "temperature sensitive" should read --temperature-sensitive--.
Line 67, "cold pen 3" should read --cold-pen 3--.

COLUMN 7

Line 38, "cold pen 3" should read --cold-pen 3--.
Line 60 "detail the" should read --detail, the--.
Line 63, "32°C.)" should read --32°C.),--.

COLUMN 8

Line 1, "layers At" should read --layers. At--.
Line 23, "with pens can" should read --using a hot or cold-pen, color change can--.

UNITED STATES PATENT AND TRADEMARK OFFICE

CERTIFICATE OF CORRECTION

PATENT NO. : 5,011,445

DATED : April 30, 1991

INVENTOR(S) : NORIKAZU NAKASUJI ET AL. Page 3 of 3

It is certified that error appears in the above-identified patent and that said Letters Patent is hereby corrected as shown below:

COLUMN 9

Line 6, "over" should read --above--.

Signed and Sealed this

Fifteenth Day of December, 1992

*Attest:*

DOUGLAS B. COMER

*Attesting Officer*

*Acting Commissioner of Patents and Trademarks*